US008177240B2

(12) United States Patent
Ressin

(10) Patent No.: US 8,177,240 B2
(45) Date of Patent: May 15, 2012

(54) ROLLER SKATE

(76) Inventor: Bernd Ressin, Oldenswort (DE)

( * ) Notice: Subject to any disclaimer, the term of this patent is extended or adjusted under 35 U.S.C. 154(b) by 0 days.

(21) Appl. No.: 12/599,262

(22) PCT Filed: May 7, 2008

(86) PCT No.: PCT/EP2008/003659

§ 371 (c)(1),
(2), (4) Date: Jun. 28, 2010

(87) PCT Pub. No.: WO2008/135281

PCT Pub. Date: Nov. 13, 2008

(65) Prior Publication Data

US 2010/0264611 A1 Oct. 21, 2010

(30) Foreign Application Priority Data

May 8, 2007 (DE) ..... 10 2007 021 455

(51) Int. Cl.
*A63C 17/04* (2006.01)

(52) U.S. Cl. ..... 280/11.12; 280/11.217; 280/11.221

(58) Field of Classification Search ..... 280/11.201, 280/11.204, 11.207, 11.19, 11.221, 11.211–11.212, 280/11.214–11.215; 188/4 R, 26, 30, 31
See application file for complete search history.

(56) References Cited

U.S. PATENT DOCUMENTS 5,088,748 A * 2/1992 Koselka et al. ..... 280/11.206
5,135,244 A * 8/1992 Allison ..... 280/11.28
5,239,941 A * 8/1993 Chibi ..... 74/502.2
5,320,367 A * 6/1994 Landis ..... 280/11.212
5,342,071 A * 8/1994 Soo ..... 280/11.207
5,403,021 A * 4/1995 Shifrin ..... 280/11.215
5,478,094 A * 12/1995 Pennestri ..... 280/11.207
(Continued)

FOREIGN PATENT DOCUMENTS

DE 196 31 882 2/1998
(Continued)

OTHER PUBLICATIONS

International Search Report issued in corresponding International application No. PCT/EP2008/003659 mailed Aug. 22, 2008.

*Primary Examiner* — J. Allen Shriver, II
*Assistant Examiner* — James Triggs
(74) *Attorney, Agent, or Firm* — Lempia Summerfield Katz LLC

(57) ABSTRACT

The invention relates to a roller skate (2), in particular an inline roller skate, comprising a plurality of rollers (4, 6, 8, 10). In order to simplify braking and to improve the dosage of the braking force and the driving stability of essentially inline roller skates during braking, the roller skate (2) comprises a first frame part (12), which is or can be rigidly connected to a shoe and in which at least one of the front rollers (4, 6) is rotatably mounted, a second frame part (14), in which at least two rear rollers (8, 10) are rotatably mounted, the two frame parts (12, 14) being pivotable about a pivoting axis (24) which is parallel to the rotational axes of the rollers (4, 6, 8, 10), and a braking element (34) that can be pressed against at least one of the rear rollers (8, 10) during pivoting of the two frame parts (12, 14) relative to one another.

19 Claims, 5 Drawing Sheets

U.S. PATENT DOCUMENTS

| | | | | | |
|---|---|---|---|---|---|
| 5,501,474 | A | * | 3/1996 | Conte | 280/11.215 |
| 5,511,803 | A | * | 4/1996 | Klukos | 280/11.206 |
| 5,639,104 | A | | 6/1997 | Haldemann | |
| 5,685,550 | A | * | 11/1997 | Mayer, II | 280/11.205 |
| 5,755,449 | A | * | 5/1998 | Pozzobon | 280/11.214 |
| 5,755,450 | A | * | 5/1998 | Ellis et al. | 280/11.214 |
| 5,758,885 | A | * | 6/1998 | Lowe | 280/11.214 |
| 5,868,404 | A | * | 2/1999 | Montague | 280/11.213 |
| 5,899,465 | A | * | 5/1999 | Mayer, II | 280/11.206 |
| 5,904,359 | A | * | 5/1999 | Caeran et al. | 280/11.15 |
| 5,908,197 | A | * | 6/1999 | Strothmann et al. | 280/11.211 |
| 5,927,728 | A | | 7/1999 | Gignoux et al. | |
| 5,997,015 | A | * | 12/1999 | Bellehumeur | 280/11.215 |
| 6,039,330 | A | * | 3/2000 | Hoskin | 280/11.215 |
| 6,164,668 | A | * | 12/2000 | Majeski | 280/11.214 |
| 6,217,038 | B1 | * | 4/2001 | Moe | 280/11.207 |
| 6,227,551 | B1 | * | 5/2001 | Roy | 280/11.223 |
| 6,425,588 | B1 | * | 7/2002 | Holland | 280/11.208 |
| 6,561,525 | B1 | * | 5/2003 | Chou | 280/11.221 |
| 6,644,673 | B2 | * | 11/2003 | Longino | 280/11.28 |
| 6,874,794 | B2 | * | 4/2005 | Holland | 280/11.206 |

FOREIGN PATENT DOCUMENTS

| | | |
|---|---|---|
| EP | 0 763 373 | 3/1997 |
| EP | 0 795 348 | 9/1997 |
| EP | 1 201 273 | 5/2002 |

* cited by examiner

ROLLER SKATE

RELATED APPLICATION DATA

This U.S. national phase application is based on international application no. PCT/EP2008/003659, filed on May 7, 2008, which claimed priority to German national patent application 10 2007 021 455.5 filed on May 8, 2007. Priority benefit of these earlier filed applications is hereby claimed, and the full disclosures of these earlier filed applications are hereby incorporated by reference herein.

BACKGROUND

1. Field of the Disclosure

The present invention concerns roller skates with a plurality of rollers, and especially inline skates; however, the roller skates according to the present invention can also be two-track roller shoes or skateboards.

2. Description of the Related Art

Commercial inline skates usually comprise a pair of shoes on the soles of which so-called tracks or supporting frames are secured for a plurality of rollers arranged behind one another that can rotate around parallel rotary axes. The braking of the inline skates usually is done with the aid of a brake pad or rubber stopper, which is secured rigidly at the back end of the supporting frame of one of the two inline skates of each pair and which can be brought into contact with the ground by tipping the entire inline skate through a lifting of the tip of the shoe to which it belongs around the rotary axis of the roller that is farthest back. However, in this type of braking the braking path depends not only on the braking force but also on the frictional coefficient between the brake pad and the ground and thus on the surface properties of the ground. Since, additionally, the braking force cannot be controlled accurately and the shoe to which the braking is applied still rolls on a single roll and thus the traveling stability during braking suffers, very unsatisfactory braking results are achieved frequently, especially by beginning skaters.

SUMMARY

Based on this, the task of the invention is to improve a roller skate of the type described at the outset by simplifying the braking, by making the braking force more controllable, and, especially in the case of inline skates, by improving the riding stability during braking.

In order to solve this task, the roller skate according to the invention comprises a first frame part that is rigidly connected to a shoe or can be thus connected, in which at least one front roller is supported rotatably, a second frame part in which at least two back rollers are supported rotatably, whereby the two frame parts can be pivoted with respect to one another around a pivot axis that is parallel to the rotary axes of the rollers, a braking element that can be pressed against at least one of the back rollers by a pivoting of the two frame parts and a braking lever, which is connected pivotably to one of the two frame parts and the longer force or power arm of which can receive a force during braking by pivoting of the first frame part with respect to the second frame part, while its shorter resistance or work arm acts directly or indirectly on the braking element, increasing the force introduced into the force or power arm and therefore to increase the force introduced into the braking element upon pivoting of the two frame parts. Moreover, the use of a braking lever between the first frame part and the braking element also permits more accurate application of the braking force.

The invention will be explained below using the example of inline skates, for which the invention is of special advantage, but it can also find application in other roller skates.

As in the conventional inline skates, in the inline skates according to the invention, during riding on flat ground all rollers are in contact with the ground, but in difference to conventional inline skates, for the purpose of braking, the first frame part is pivoted with respect to the second frame part by a tipping movement of the shoe. Hereby, the front rollers that are supported in the first frame part are lifted from the ground while the back rollers that are supported in the second frame part all remain in contact with the ground, as a result of which the riding stability during braking can be improved significantly. Since, depending on the angle of pivoting of the two frame parts, the braking element is pressed against the two back rollers with a variable force, the braking force can be controlled very accurately by pivoting the tip of the shoe to a different extent away from the ground. Since the surface properties of the rollers and of the braking element are not changed or are changed only insignificantly in the case of moisture, the frictional coefficient between the back rollers to which the braking is applied and the braking element is essentially constant.

According to a preferred embodiment of the invention, the braking element is mounted in the second frame part and can be moved against the force of a return spring, which also serves to pivot back the first frame part with respect to the second frame part after braking, to the extent that the skater does not himself lower the tip of the shoe again downward.

Another preferred embodiment of the invention provides that the braking element can be pressed with essentially the same force against both back rollers. A uniform pressing against both back rollers is preferably achieved by the fact that the braking element is supported on the return spring in a floating manner. The braking element is preferably provided with recesses for a part of the rollers, so that it is not pressed in the region of the tread or running surface but on both sides of this against the side flanks of the rollers. As a result of this, adverse influence on the braking force by possible wear or any dirt that may be on the running surface is avoided.

Expediently, the braking lever is a second class or one arm lever, which is preferably joined to the second frame part pivotably as seen in the direction of travel in front of the pivoting axis of the two frame parts, whereby its power arm is supported behind the pivoting axis against the first frame part, and its work arm acts somewhat below the pivoting axis on the braking element, in order to press this downward against the back rollers. The pivotable joint between the braking lever and the second frame part is produced expediently with the aid of a pivot or hinge bolt, which extends into the braking lever with the aid of aligned cross holes in the braking lever and into two opposite side parts or side cheeks of the second frame part. In order to avoid hindrance of the pivoting of the first frame part by the hinge bolt, two opposite side parts or side cheeks of the first frame part are expediently provided with recesses along a pivoting path of the pivot or hinge bolt.

According to a further advantageous embodiment of the invention, the resistance or work arm abuts with a rounded crown of a downward pointing [lifting] projection of the braking lever onto a flat upper side of the braking element, so that upon swiveling the braking lever remains in line contact with the upper side of the braking element. In contrast to that, the force or power arm is supported, preferably from below, with an upward facing surface against a force-introducing bolt that is placed into the aligned cross holes in opposite side parts or side cheeks of the first frame part and is swiveled downward together with the back end of the first frame part when the tip of the shoe together with the front end of the first frame part is lifted from the ground

BRIEF DESCRIPTION OF THE DRAWINGS

The invention will be explained below in more detail with the aid of a practical example shown in the drawing. The following are shown.

DETAILED DESCRIPTION OF THE DISCLOSURE

Figure 1:
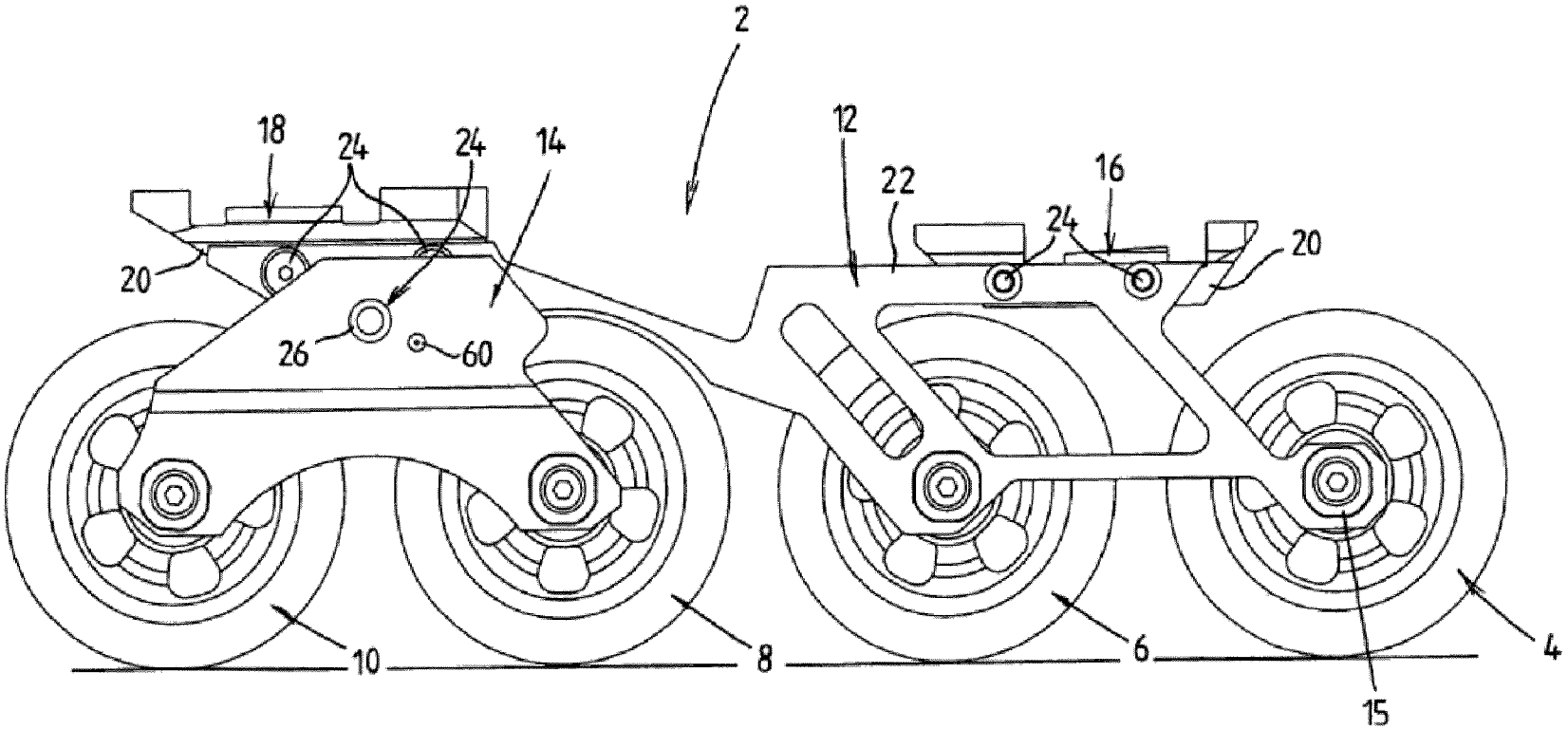
FIG. 1: is a side view of parts of a roller skate according to the invention in the form of an inline skate shown without the shoe, with two pairs of rollers in a riding position.

As shown best in FIG. 1, the inline skate 2 shown in the drawing in detail without a shoe has four rollers 4, 6, 8, 10 arranged in a row behind one another, as well as two frame parts 12, 14 that are joined to one another, namely a rigid first frame part 12 that can be attached to the shoe in which the two front rollers 4, 6 are supported rotatably around parallel rotary axes, as well as a second frame part 14 in which the two back rollers 8, 10 are supported rotatably around parallel rotary axes.

The two frame parts 10, 12 are preferably produced from plastic by injection molding, whereby they are either composed of two individual mirror-image halves joined together with spacers and transverse screws (neither of the two are shown) or alternatively it can be formed in one piece with a U-shaped cross-section. The securing of the ball-bearing supported rollers 4, 6, 8, 10 in the frame parts 12, 14 is carried out in the known manner from both sides with fastening screws 15.

For securing to the shoe, the first frame part 12 is provided with two adapters 16, 18 on its top side, which are attached in a longitudinal direction of the inline skates 2 at a horizontal distance to one another above from the front or from the back roller pair 4, 6, or 8, 10, respectively, and they can be screwed onto the shoe through a perpendicular bore 17 in adapter 16, 18, as well as through a corresponding bore in the sole of the shoe.

The adapters 16, 18 each have a bottom part 20, which can be introduced from above between two side cheeks 22 on the top side of the first frame part 12, and they are at a distance to one another that corresponds to the width of the lower part 20 and then it can be rigidly joined from the opposite sides using two screws 24 in each case, to the two side cheeks 22 of frame part 12.

The second frame part 14 can be pivoted with respect to the first frame part 12 around a pivoting axis 24 which is parallel to the rotary axes of rollers 4, 6, 8, 10. The pivoting axis 24 is located above an intermediate space between the two back rollers 8, 10, which are always in contact with the ground, whereby the distance of the pivoting axis 24 from the ground corresponds approximately to the diameter of rollers 4, 6, 8, 10. The pivoting axis 24 is formed by a hollow cylindrical pivoting bolt 26, which can be introduced from one side via aligned through openings 28, 30 in the side cheeks 22 of the first frame part 12 or can be introduced into two parallel side cheeks 32 of the second frame part 14 that overlap the side cheeks 22 on their outsides from below, as shown best in FIG. 4. After introduction into the cylindrical through openings 28, 30, the pivoting bolt is secured in the axial direction so that it cannot be lost.

Figure 2:
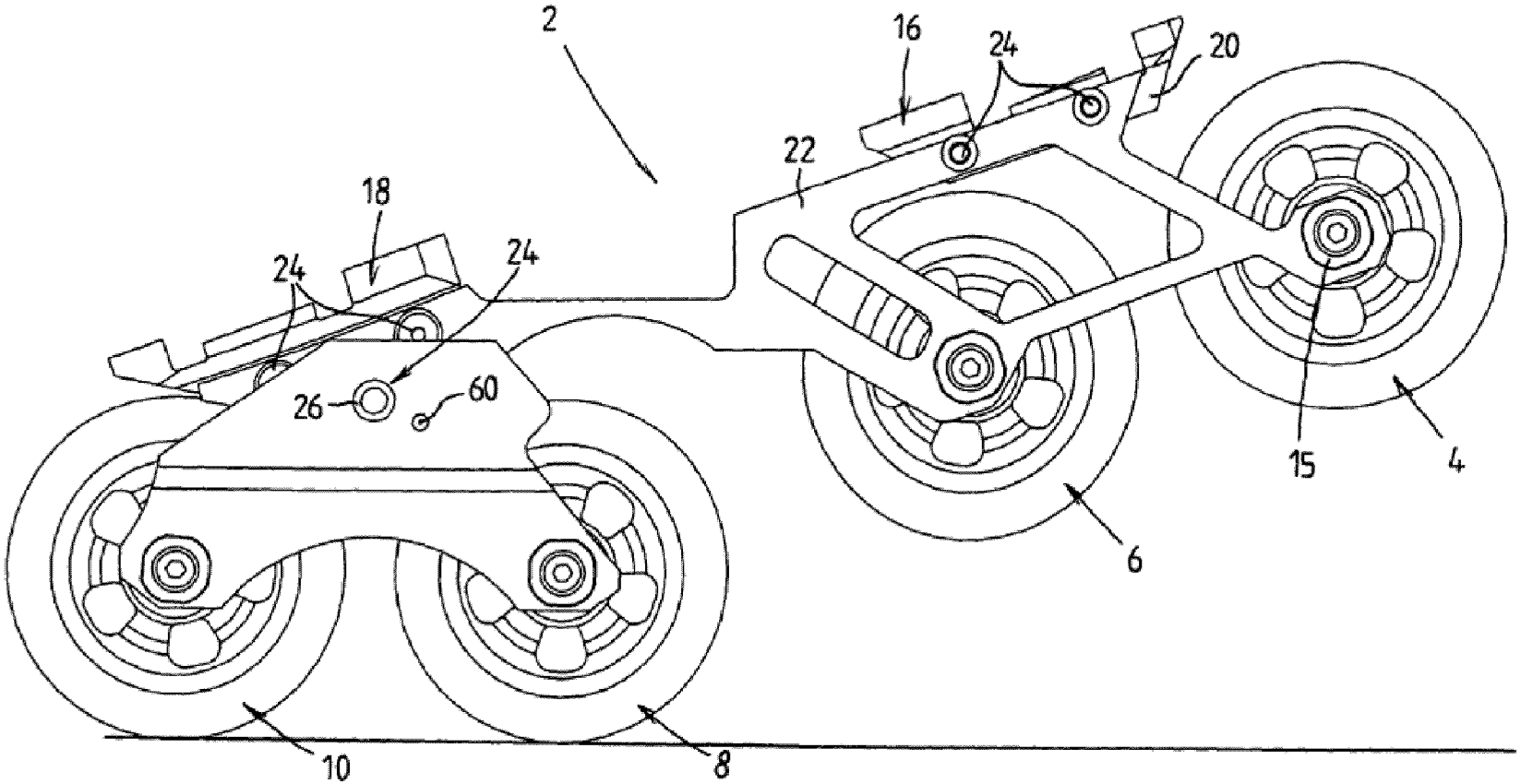
FIG. 2: is a side view corresponding to FIG. 1, but in a braking position.
Figure 3:
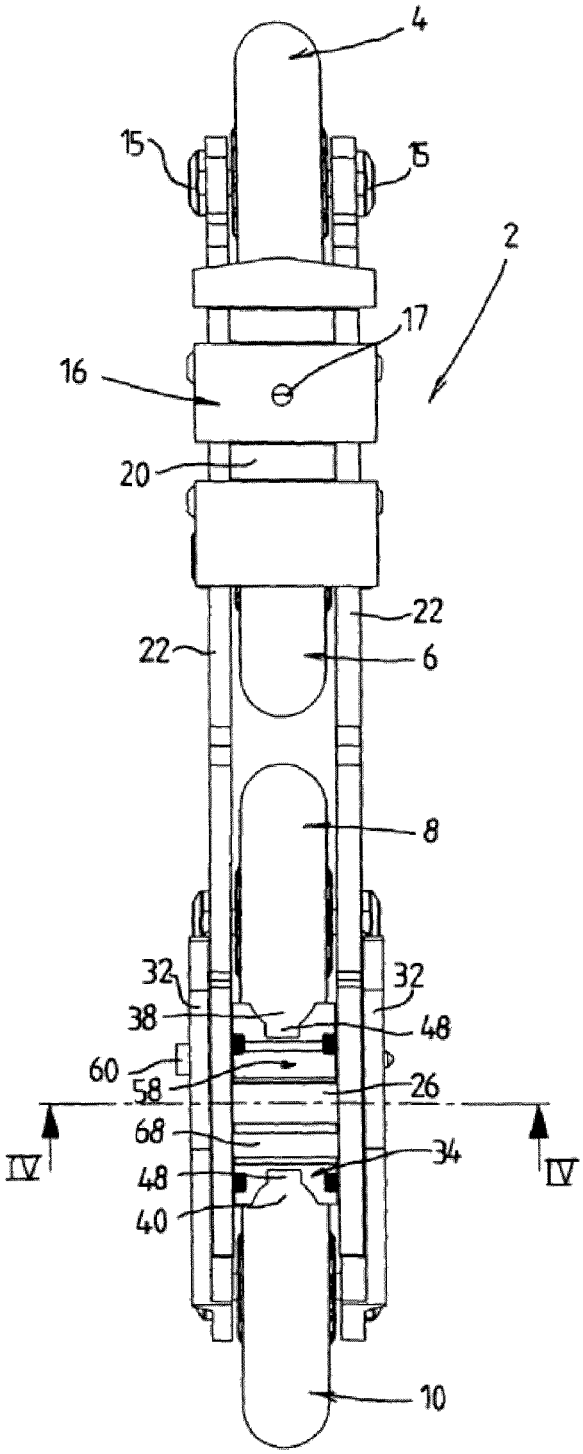
FIG. 3: is a view from the top onto the inline skate, but without an adapter above the back pair of rollers, which serves to secure it to the shoe

The inline skate 2 has a brake, which can be activated by a pivoting of the two frame parts 12 with respect to one another, by the skater moving the first frame part 12 by lifting the tip of the shoe from the riding position shown in FIG. 1, where all rollers 4, 6, 8, 10 are in contact with the ground, into the braking position shown in FIG. 2, in which the two front rollers 4, 6 are lifted from the ground and at the same time the two back rollers 8, 10 that are in contact with the ground have a braking force applied to them.

As best shown in FIGS. 4 to 8, the brake comprises a brake pad 34 mounted in the second frame part 14, which moves into the braking position (FIG. 2) as a result of the pivoting movement of the first frame part 12 against the force of a return spring 36, from an upper, inactive position lifted away from the two back rollers 8, 10 (FIG. 5), downward, and is pressed against the side peripheral surfaces of the two back rollers 8, 10 in order to brake these two rollers 8, 10.

Figure 7:
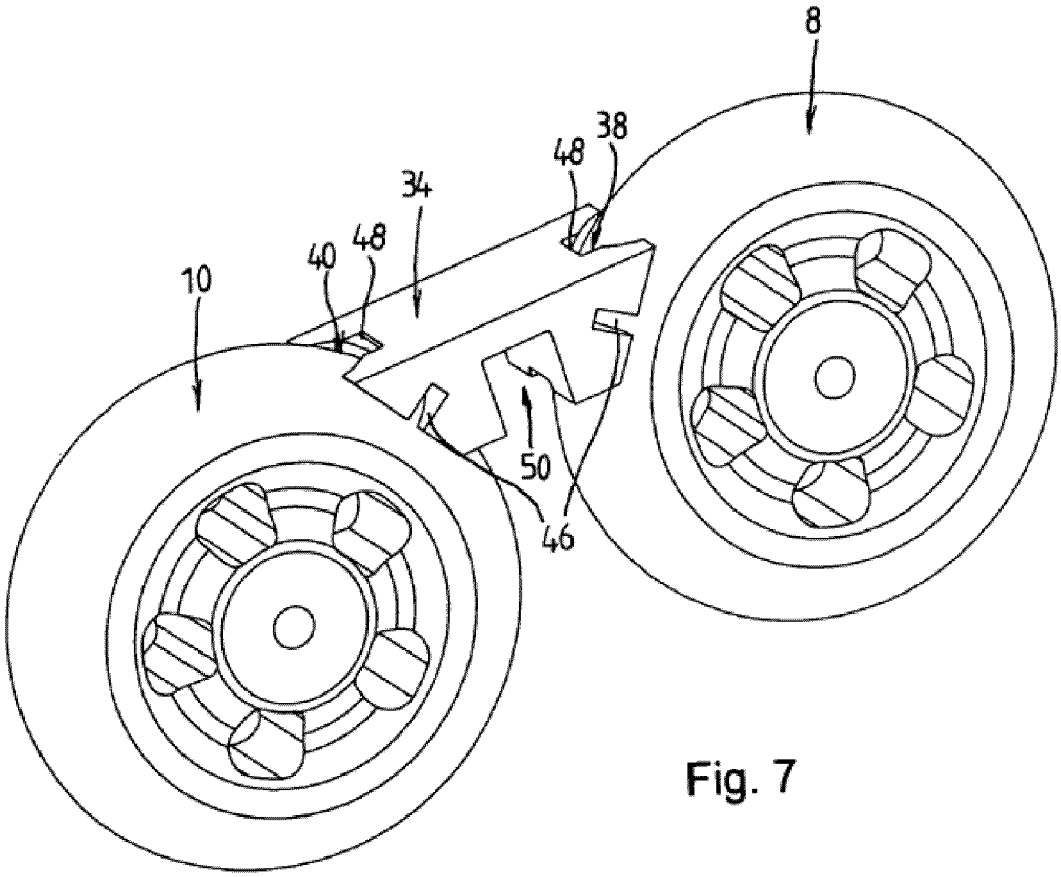
FIG. 7: is a perspective top side view of two back rollers and of a brake pad that can be pressed against the rollers of the inline skate.
Figure 8:
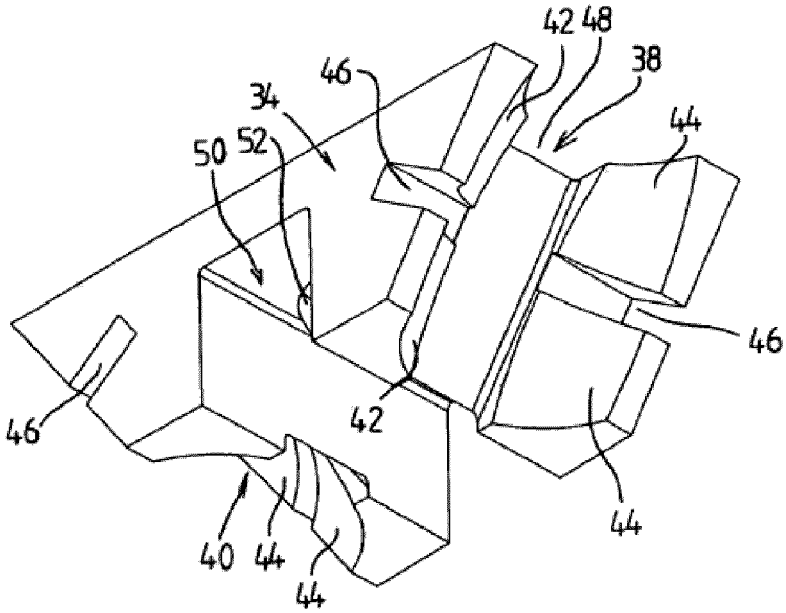
FIG. 8: is a perspective view of the brake pad from the bottom.

As best seen in FIGS. 7 and 8, the brake pad 34 has a trapezoidal cross-section when viewed from the side and in its opposite lying flanks pointing in a slanted manner downward it is provided with two recesses 38, 40 for parts of the two back rollers 8, 10. Each of the two recesses 38, 40 has two symmetrical braking surfaces 42, 44 lying opposite to one another and symmetrically with respect to a longitudinal plane of the inline skate 2, the form of which is complementary to the form of the rollers 8, 10, on both sides of their middle running surfaces that roll on the ground, so that the braking surfaces 42, 44 lie flat against the side peripheral surfaces of the rollers 8, 10 and are pressed against them regardless of any wear of the running surfaces or of impurities that may adhere to the running surfaces. In order to avoid the stripping off of contaminants adhering to the running surfaces of the rollers 8, 10 by the brake pad 34, leading to an adverse effect on the functioning of the brake, the recesses 38, 40 are provided with widenings 48 which widen radially outward from the running surfaces of the rollers 8, 10, so that impurities on the running surfaces themselves can go through between the rollers 8, 10 and the brake pad 34, when this is pressed against the rollers 8, 10 upon gentle braking. The brake pad is provided with transverse aeration slits 46 for better removal of the heat during braking.

The brake pad 34 is provided with a recess 50 that is open downward and to both sides for the return spring 36. The return spring 36 is a helical pressure spring, which rests with its upper front end in a cylindrical, downward opening indentation 52 arranged on the upper end of the recess in the brake pad 34, and with its lower front end it rests on the top side of a transverse bridge 54 that connects the two side cheeks 32 of the second frame part 14. As a holder for the spring 36, a peg 56 is used, which is formed in one piece with the transverse bridge 54 and penetrates from below into the inside of the helical pressure spring 36 and, together with the indentation 52 of the brake pad 34, prevents transverse movements of the helical pressure spring 36, as shown best in FIGS. 4, 5 and 6. The recess 50 in the brake pad 34 had a width which corresponds to the outer diameter of the helical pressure spring 36 and, together with the indentation 52 and peg 56 forms a guide for the spring 36 so that in the riding position (FIG. 1) the brake pad 34, which is supported by spring 36 and thus floats in the second frame part 14, can move essentially only in the direction of the longitudinal axis of spring 36.

Figure 4:
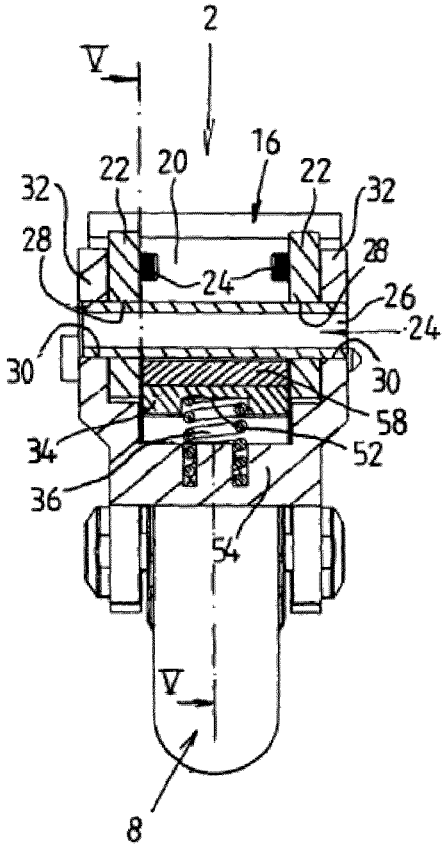
FIG. 4: is a cross-sectional view along IV-IV from FIG. 3.
Figure 5:
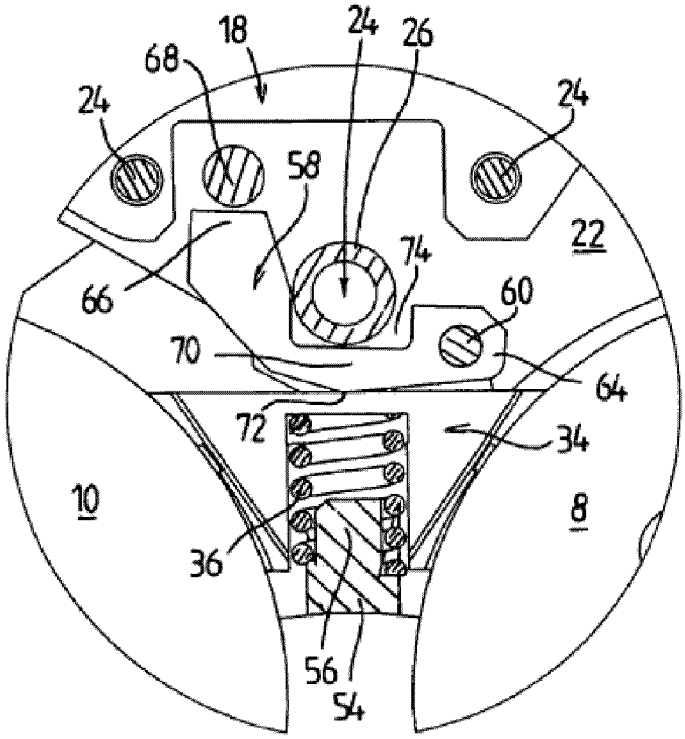
FIG. 5: is an enlarged section of a cross-section along line V-V in FIG. 4 in the riding position from FIG. 1.
Figure 6:
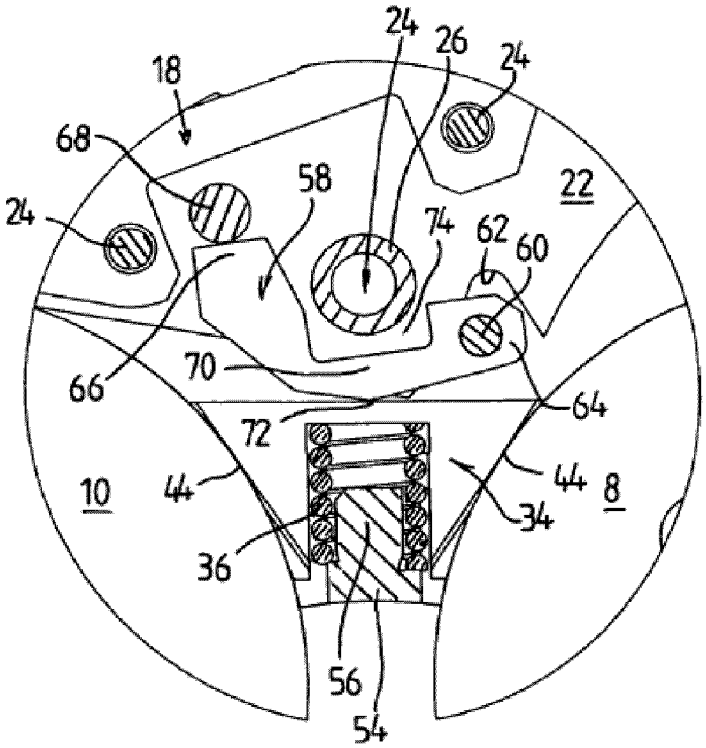
FIG. 6: is the same section as FIG. 5, but in the braking position from FIG. 2.

In order to ensure, on the one hand, rapid braking action and the application of a good, continuous braking force, and on the other hand to increase this introduced braking force upon pressing the brake pad 34 against rollers 8, 10, the brake comprises a brake lever 58 which is positioned between the first frame part 12 and the brake pad 34. As best seen in FIGS. 4, 5 and 6, the brake lever 58 is arranged above the brake pad 34 in the intermediate space between the two side cheeks 22 of the first frame part 12, whereby it extends between the hollow cylindrical pivoting bolts 26 that serve as pivoting axis 24 and through the flat top side of the brake pad 34. In a side view, the brake lever 58 appears approximately as having the shape of a lying down C. Its front end 64 facing the direction of travel can be swiveled with the aid of a hinge bolt 60 that is parallel to the pivoting axis 24 through recesses 62 that open at the edge downward (FIG. 6) in the side cheek 22 while it is joined to the side cheeks 32 of the second frame part 14. The back end 66 of the brake lever 58, when viewed in the direction of the travel protrudes behind the pivoting axis 24 upward and is pressed through the brake pad 34 by the return spring 36 from the bottom, against force-introducing bolts 68 that are parallel to the hinge bolts 60, which extends transversely through the intermediate space between the side cheeks 22 of the first frame part 10 and is rigidly connected to it. The middle part 70 of the brake lever 58 lies in the extension of the longitudinal axis of the helical pressure spring 36 from the top against the flat top side of the brake pad 34. At this location, at its bottom side it has a flat raised part with a rounded crown 72 so that it is in line contact with the top side of the brake pad 34 in the positions shown in both FIG. 5 and FIG. 6. Toward the top the middle part 70 of the brake lever 58 is provided with a recess 74 which is open toward the top through which the pivoting bolt 26 extends.

When the first frame part 12 is pivoted around the pivoting axis 24 from the riding position (FIG. 1) into the braking position (FIG. 2), the front end of the first frame part 12 moves upward while correspondingly its back end moves downward together with the power introducing bolt 68. Hereby the power introducing bolt 68 acts with a force on the longer power arm of the brake lever 58, which presses the back front end 66 of the brake lever 58 against the force of the helical pressure spring 36 downward. As a result of this, the brake lever is pivoted in a clockwise direction from the position shown in FIG. 5 into the position shown in FIG. 6, whereby the shorter work arm acting on the brake pad 34 presses the brake pad 34 downward while increasing the force acting on the front end 66, until the braking surfaces 42, 44 are pressed with a braking force against the rollers 8, 10 in the position shown in FIG. 6.

When the inline skater 2 applies the brake by lifting the tip of the shoe, the force introduced from the tip of the foot of the skater into the tip of the shoe is enhanced thus by two levers, on the one hand, by the frame part 12 that can be pivoted around the pivoting axis 24 that forms a two-armed lever with a longer lever arm located in the direction of travel in front of the pivoting axis 24 and a shorter lever arm that is located in the direction of travel behind the pivoting axis, as well as, on the other hand, by the one-armed brake lever 58 that can be pivoted around the hinge bolt 60. This double lever action permits introduction of very high braking forces into rollers 8, 10 with a very small effort, whereby the braking force moreover can be adjusted very accurately by the pivoting angle of the first frame part 12.

The invention claimed is:

1. Roller skate with a plurality of rollers, the roller skate comprising a first frame part that is or can be connected rigidly to a shoe, in which at least one front-most of the rollers is supported rotatably, a second frame part, in which at least two back rollers are supported rotatably, whereby both frame parts are pivotable with respect to one another around a pivoting axis that is parallel to the rotary axes of the rollers, a braking element, which can be pressed against at least one of the back rollers by a pivoting of the two frame parts with respect to one another, and a braking lever which is connected pivotably to one of the two frame parts, the braking lever having a longer force arm that can be loaded during braking with a force by a pivoting of the two frame parts with respect to one another, and having a shorter resistance arm that acts directly or indirectly on the braking element, enhancing the force.

2. Roller skate according to claim 1, wherein, when riding on a flat ground, all rollers are in contact with the ground and that for the purpose of braking the first frame part is pivotable with respect to the second frame part by a tipping movement of the shoe, whereby the rollers supported in the first frame part are lifted from the ground and the rollers that are supported in the second frame part remain in contact with the ground.

3. Roller skate according to claim 1, wherein the braking element can be pressed essentially with the same force against both of the two back rollers.

4. Roller skate according to claim 1, wherein the braking element is mounted in the second frame part and is moveable against the force of a return spring.

5. Roller skate according to claim 4, wherein the braking element is supported on the return spring in a floating manner.

6. Roller skate according to claim 4, wherein the return spring pivots the first frame part backwards with respect to the second frame part.

7. Roller skate according to claim 1, wherein the braking element is provided with recesses for the rollers so that on both sides of a tread of the rollers pressure can be exerted against the rollers.

8. Roller skate according to claim 1, wherein the braking lever is connected pivotably to the second frame part through a pivot joint.

9. Roller skate according to claim 8, wherein the pivot joint comprises a pivot joint bolt that extends through aligned cross holes into opposite side parts of the second frame part as well as into the brake lever.

10. Roller skate according to claim 9, wherein the opposite side parts of the first frame part are provided with recesses along a pivoting path of the pivot joint bolt.

11. Roller skate according to claim 1, wherein the brake lever is a second class lever, which is connected pivotably to the second frame part, as seen in the direction of travel of the roller skate in front of the pivoting axis, whereby the force arm is acting against the first frame part, as seen in the direction of travel behind the pivoting axis, and whereby the resistance arm acts below the pivoting axis against the braking element.

12. Roller skate according to claim 11, wherein the resistance arm has a protrusion extending downwardly, the protrusion having a rounded crown that abuts against the braking element.

13. Roller skate according to claim 11, wherein the force arm abuts from below against a force-introducing bolt, which is placed in aligned cross holes in opposite side parts of the first frame part.

14. Roller skate according to claim 4, wherein the return spring is a helical pressure spring generally oriented vertically, which abuts with its lower front end against the second frame part and with its upper front end against the braking element.

15. Roller skate according to claim 14, wherein the helical pressure spring is guided in the second frame part and/or in the braking element, so that the braking element can be moved essentially only in the direction of a longitudinal axis of the helical pressure spring.

16. Roller skate according to claim 14, wherein the helical pressure spring extends with its upper front end into a complementary indentation of the braking element and with its lower end onto a complementary peg of the second frame part.

17. Roller skate according to claim 1, wherein the first and/or the second frame part is/are made of one piece and generally has/have a U-shaped cross-section.

18. Roller skate according to claim 1, wherein the first and/or the second frame part is/are composed of two essentially mirror image halves joined together with screws.

19. Roller skate according to claim 1, wherein the first and/or the second frame part is/are manufactured from plastic by injection molding.

* * * * *